United States Patent [19]

Vigil

[11] Patent Number: 4,721,057

[45] Date of Patent: Jan. 26, 1988

[54] INDEXING DEVICE FOR BOOKS

[76] Inventor: Anthony E. Vigil, 40 Saddlehorn Trail, Monument, Colo. 80132

[21] Appl. No.: 841,154

[22] Filed: Mar. 19, 1986

[51] Int. Cl.[4] ..... B42D 9/00

[52] U.S. Cl. ..... 116/238; 116/234

[58] Field of Search ..... 116/234–240; 281/42; 248/282; 403/71; 411/508–510

[56] References Cited

U.S. PATENT DOCUMENTS

| | | | |
|---|---|---|---|
| 1,937,442 | 11/1933 | Scognamillo | 281/42 |
| 2,435,886 | 2/1948 | Hayes | 116/238 |
| 3,016,036 | 1/1962 | Jorgensen | 116/238 |
| 3,490,300 | 1/1970 | Toma | 411/508 |
| 4,335,903 | 6/1982 | Collins et al. | 281/42 |

FOREIGN PATENT DOCUMENTS

| | | | |
|---|---|---|---|
| 20366 | of 1911 | United Kingdom | 281/42 |
| 257529 | 9/1926 | United Kingdom | 116/237 |

*Primary Examiner*—Charles Frankfort
*Assistant Examiner*—W. Morris Worth
*Attorney, Agent, or Firm*—Timothy J. Martin

[57] ABSTRACT

An indexing device provides a bookmark for a reader to indicate the reader's place in the book for successive reading sessions. The device includes a flexible prong held in position between two leaves of the book from an edge location by an arm member. The arm member is preferably pivotally secured to a base that releaseably attaches to the book. Several embodiments showing different mounting structures are described.

8 Claims, 8 Drawing Figures

INDEXING DEVICE FOR BOOKS

BACKGROUND OF THE INVENTION

The present invention relates to an indexing device which may be implemented as a bookmark for marking a reader's place in a book. The present invention is particularly directed to such an indexing device which may be releasably secured to the cover of a book and which device will automatically mark a selected reference location between the spread of two leaves of the book without requiring that the reader position the bookmark following each reading session.

In the past, readers of books have found it desirable to mark a book at a selected reference location between successive reading sessions so that the reader does not have to memorize his or her "place" in the book, for example, by remembering the last page number. To avoid remembering this page number, some readers resort to folding a corner of that page. When a reader employs this method of marking the book, those leaves become damaged, torn or otherwise marred so that it is desirable to implement other, mechanical techniques to index the reader's location.

Typical page markers have in the past included paper clips, small strips of paper, cardboard or plastic which may be placed between the spread of two consecutive leaves of the book, or the use of a string or ribbon that may be placed between the leaves. A disadvantage of paper clips, of course, is the possibility of damage to the book leaves. While the other techniques mentioned above are less likely to damage the physical integrity of the book, readers often find that they misplace or lose the mechanical markers where they are not physically secured to the book. To avoid losing the bookmarker, in the case of the ribbon, some manufacturers have permanently attached the ribbon or string in the book's binding, but this solution results in increased manufacturing expense and does not permit the marker to be used on any book other than that to which it is attached. Other manufacturers have included clip mechanisms on strips of plastic which clips may be mounted directly to a leaf of the book, but this technique is comparable to the utilization by some readers of paper clips on the leaves of the book and may again damage the leaf of the book.

Further, all the devices described above require that the reader manually move the index market from place to place for each successive reading session. Many readers find this bothersome. Accordingly, there remains a need for a bookmark which will automatically position itself as a reader turns each consecutive leaf of the book that he or she is reading. There is further a need for such an automatic book marking device which may be employed on numerous different books, both hard-back and paperback, while minimizing any physical damage to the book. The need for such an automatic bookmark extends further to the need for a device which may be mounted fairly securely to the book yet which may be easily removed, when desired.

SUMMARY OF THE INVENTION

It is an object of the present invention to provide a novel and useful indexing device for marking a selected reference location between two leaves of a book so that a reader's place in the book is maintained for successive reading sessions.

It is another object of the present invention to provide a mechanical indexing device which may be releasably secured to a book without damaging the book and which provides a structure for automatically maintaining the reader's place as the reader turns consecutive pages of the book.

It is a further object of the present invention to provide a novel indexing device of relatively inexpensive and simple construction which may be used by readers on a variety of books to mark the reader's place therein without requiring the reader to manually move the marker from place to place during successive reading sessions.

Accordingly, the broad form of the present invention is directed to an indexing device adapted to function as a bookmark for marking a selected referenced location of a reader within a book. To this end, the preferred form of the present invention includes a flexible element adapted to extend from an edge location along the book into the gatherings of the book, an arm means for positioning the flexible element at the edge location, and a support means is secureable to the book for supporting the arm means whereby the flexible element may be positioned between the spread of the book's leaves.

In the preferred form of the present invention this indexing device includes a base which may be mounted to the cover of the book and an arm member that is pivotally mounted to the base and extends alongside an edge of the book adjacent the leaves. A flexible prong is mounted adjacent the free end of the arm member so that the prong member may extend inbetween two consecutive leaves to indicate the reader's place in the book. Preferably, this prong, is resilient, and a resistance means is provided for resisting the pivotal movement of the arm member with respect to the base. The resilience of the prong and the resistive ability of the resistance means are selected so that a single leaf of the book will be deflected by the prong as the reader turns the page, so that a single leaf will pass the prong without moving the arm member. However, where a group of leaves are turned as a set, for example, when the reader closes the book, the resistive force will be overcome so that the group of leaves pivot the arm member thereby maintaining the prong between the group of such leaves and an adjacent leaf. This resistance means is preferably provided by the frictional engagement of a trunnion pin interconnecting the base and arm member.

While a variety of bases are contemplated by the present invention, the preferred embodiment of the base member includes a first leg portion adapted to extend alongside the spine of the book and a second leg portion adapted to extend over a joint or hinge portion of the leaves. A finger projects from the second leg portion in spaced relation to the first leg portion and is positioned so that, when the first leg portion is placed along the spine, the finger is inserted between the gatherings of the leaves adjacent the joint portion in the book's gutter. Other bases include clip members which may receive and grip a portion of the spine or a portion of a selected one of the front and back covers of the book.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention is directed to an indexing device specifically adpated for marking a selected reference location corresponding to a reader's place in a book. To this end, the present invention is directed to a device that may releaseably attach to a book and includes an indexing means that inserts between the leaves of the book and which may automatically mark the reader's location. Accordingly, in its broad form, the present invention includes an index element adapted to extend from an edge location of a book inbetween the book's leaves; means for positioning the indexing element, and support means which attach to the book for supporting the indexing structure.

Figure 1:
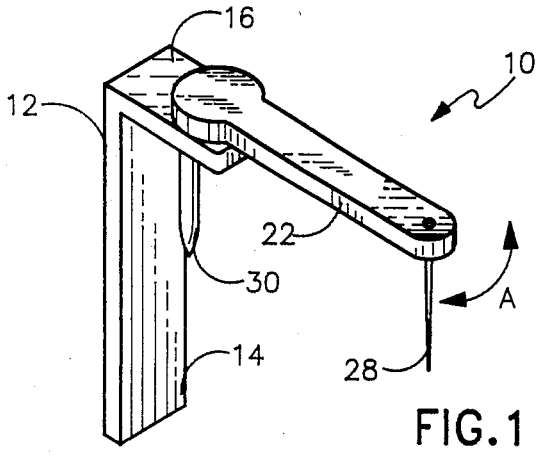
FIG. 1 is a perspective view of the indexing device according to the preferred embodiment of the present invention.
Figure 3:
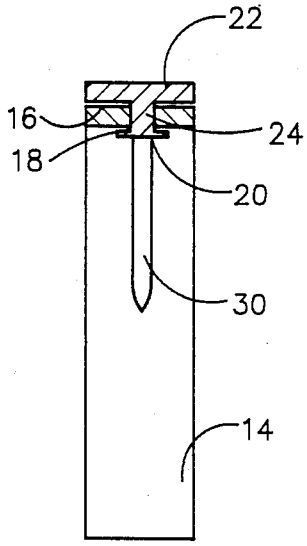
FIG. 3 is a cross-sectional view taken about lines 3—3 of FIG. 2.

In the preferred form, as is shown in FIGS. 1-4, an indexing device 10 includes a base 12 constructed of a first flat leg portion 14 and a second flat leg portion 16 oriented at right angles with respect to first leg portion 14. Second leg portion 16 has a hole 18 formed therethrough that receives a trunnion pin 20 formed on a pivot arm 22. Pivot arm 22 is mounted on leg portion 16 so that it extends away from base 12 and is generally parallel to second leg portion 16. As is best shown in FIG. 3, trunnion pin 20 is split into several sections such as provided by split at 24 so that it may be slightly compressible and includes a flange 26 that permits pivot arm 22 to be snap-locked onto second leg portion 16 through hole 18 by compressing pin 20 at splits 24. Further, as is discussed below, trunnion pin 20 is sized so that its sections exert radially outward force to frictionally engage hole 18 to provide a resistive force to pivotal motion of arm 22 in the direction shown by arrow A in FIG. 1. Pivot arm 22 mounts, at its free end, a flexible prong 28 which extends in a generally parallel spaced relation with first leg portion 14 and which may flex with two degrees of freedom. Prong 28 defines an index member that may extend inbetween two consecutive leaves of a book to indicate a reader's place in the book, as described below. While prong 28 is preferably flexible, a rigid element could be used although such rigid element would be more likely to damage the book's leaves as they are turned. A rigid mounting finger 30 forms a knife-like projection from a lower surface of second leg portion 16 as part of base 12, to facilitate mounting of indexing device 10 onto a book.

Figure 2:
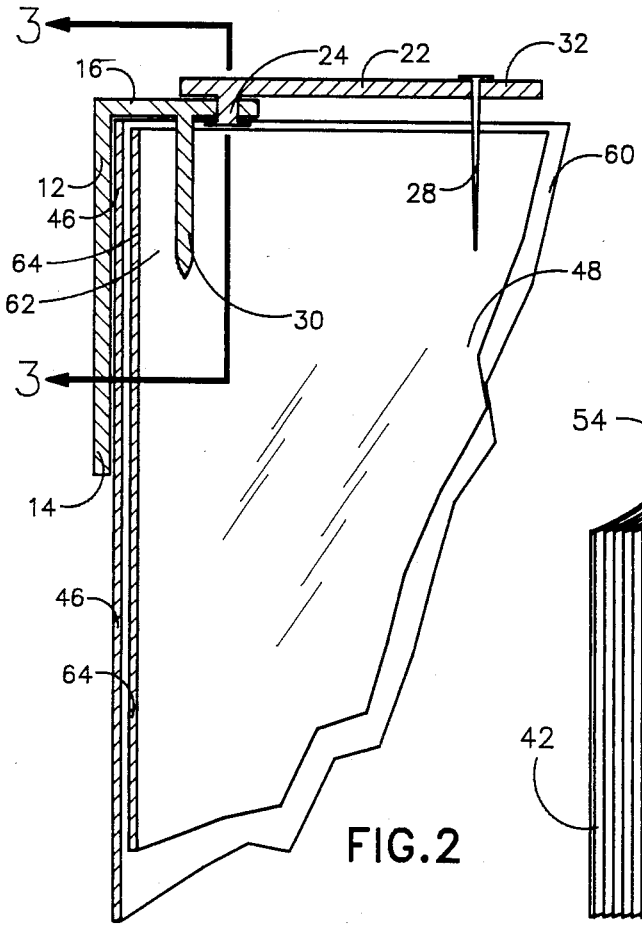
FIG. 2 is a side view in elevation of the indexing device shown in FIG. 1 shown in a mounted position in a book.
Figure 4:
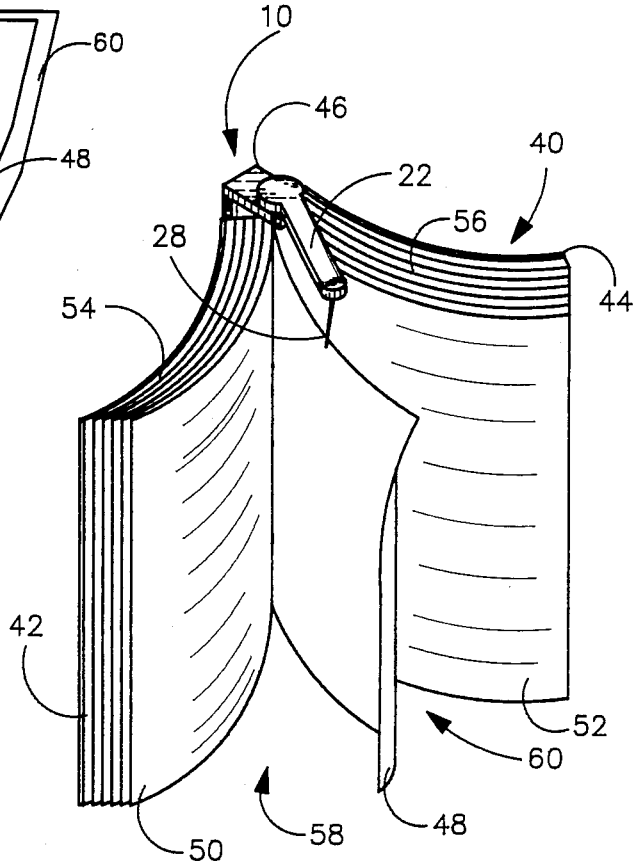
FIG. 4 is a perspective view of the indexing device shown in FIG. 1 attached to a book.

The mounting of indexing device 10 on a conventional book 40 is shown with greater specificity in FIGS. 2 and 4. Book 40, which may be a hard or soft cover book, includes a front cover board 42, a back cover board 44 and a spine 46 interconnecting cover boards 42 and 44. Book 40 includes a plurality of leaves, such as leaf 48 which may be divided into leaf groups such as leaf groups 50 and 52, all of which are secured together by the book's binding at hinge or joint 64. Leaf group 50 thus defines gatherings 54 and leaf group 52 defines gatherings 56. Accordingly, leaf 48 and leaf group 50 form a spread 58 while leaf 48 and leaf group 52 define a spread 60.

As is shown in FIGS. 2 and 4, indexing device 10 is mounted to book 40 by positioning base 12 so that first leg portion 14 extends alongside spine 46 with second leg portion 16 extending over an edge of book 40 at gutter region 62. With this mounting, finger 30 extends into the tightly packed gutter region 62 of leaves 48, 50 and 52 immediately in front of joint 64 of book 40. This securely yet releasably mounts base 12 onto book 40, and thus mounts arm 22 along edge 60 of book 40 with prong 28 extending inbetween the leaves of the book. As is shown in FIG. 4, whenever a reader turns a single page, such as page 48, prong 28 causes leaf 48 to bend therearound. The resistive force of trunnion pin 22 in hole is selected to cooperate with the resiliency of prong 28 so that a single leaf of the book is deflected by the prong, as is shown in FIG. 4, yet where a group of at least 4 leaves are turned, this resistance force will be overcome and arm member 22 will pivot to maintain prong 28 betweeen two consecutive leaves of the book when the book is closed. Preferably, the resistive force is set to resist torques of approximately 40,000 dyne cm.

Preferably, base 12 is formed as injected molded plastic pieces. Finger 30 is formed integrally with base 12, and trunnion pin 20 is formed integrally with arm 22. Flexible prong 28 is formed out of resilient rubber material that may be formed as a narrow finger extending through a hole 32 in arm 22 and secured therein in any suitable manner. Thus, the construction of indexing device 10 requires a simple mounting of finger 28 through hole 32, and a snap-fitting of trunnion pin 20 into hole 18. It should be appreciated, of course, that other materials known in the art are suitable for constructing indexing device 10 and that other methods for pivotally attaching arm 22 to base 12 are within the scope of this invention.

Figure 5:
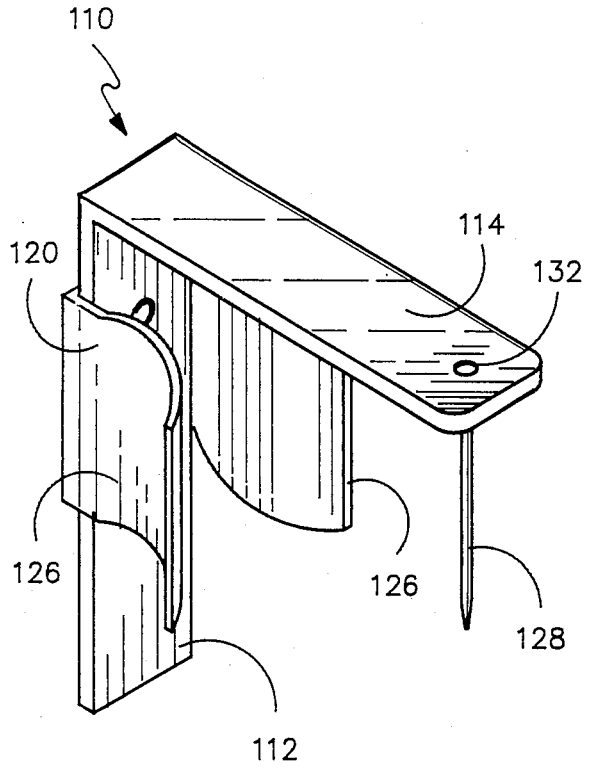
FIG. 5 is a perspective view of a first alternate embodiment of an indexing device according to the present invention.
Figure 6:
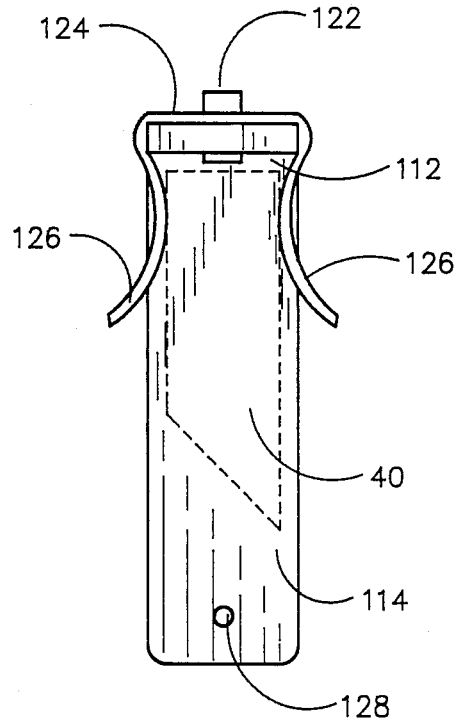
FIG. 6 is an end view in elevation of the indexing device shown in FIG. 5.

While indexing device 10 has been described with respect to the support means as defined by base 12, other support means in the form of mounting structures are also within the scope of this invention. One such example is shown in FIG. 5 wherein indexing device 110 is formed by an elongated arm 114 extending at right angles to base 112. In this embodiment, arm 114 is not pivotal with respect to base 112 although such construction could be provided in a manner similar to that described with the preferred embodiment. Arm 114 includes a small hole 132 that supports a flexible prong 128 at its free end. A channel shaped clip 120 is fastened by screws or rivets 122 to base 112 with clip 120 including a bottom wall 124 and a pair of divergent side wings 126 adapted to resiliently receive the spine portion of book 40 as is shown in phantom in FIG. 6.

Figure 7:
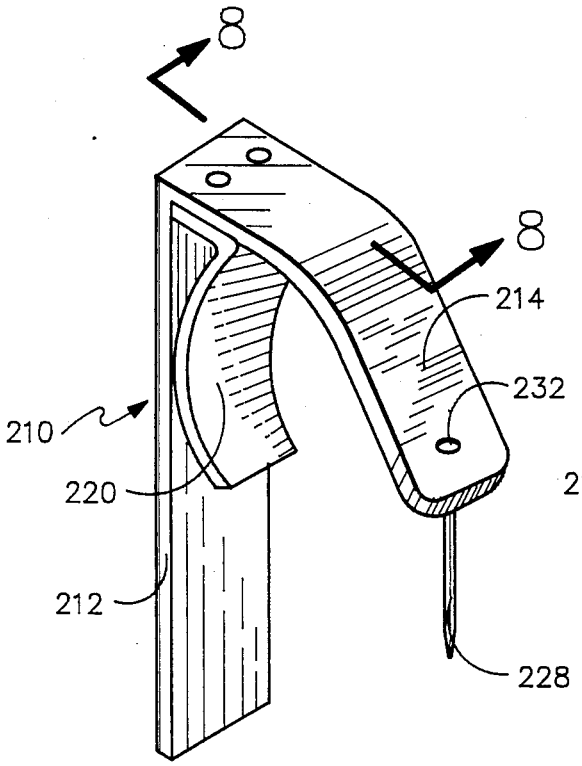
FIG. 7 is a perspective view of a second alternate embodiment of an indexing device according to the present invention.
Figure 8:
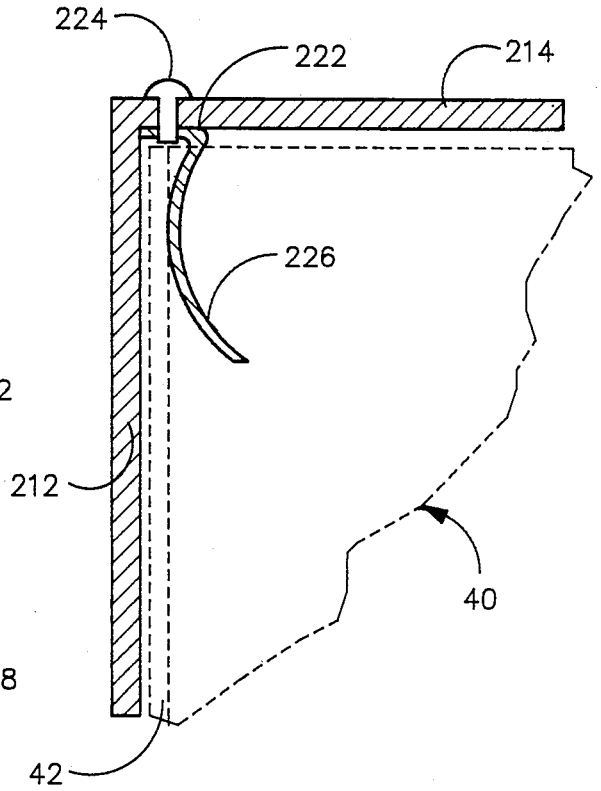
FIG. 8 is a cross-sectional view taken about 8—8 of FIG. 7.

A third embodiment of the present invention is shown in FIGS. 7 and 8 wherein an indexing device 210 includes a base 212 from which an arcuate arm 214 extends in a plane perpendicularly thereto. Again, arm 214 could be pivotally secured to base 212 if desired. Arm 214 includes a hole 232 through which flexible prong 228 is mounted, and a spring clip 220 is provided having a base 222 secured to arm 214 by means of screws or rivets 224. Clip 220 has a resilient wing 226 adapted to receive a cover, such as cover 42 of book 40 shown in phantom in FIG. 8. Since base 212 extends alongside a cover of book 40, the curvature of arcuate arm 214 is selected so that prong 228 will lie centrally of the leaves of book 40.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. An indexing device for marking a selected reference location between the spread of two leaves of a book having a cover formed by front and back cover boards and a spine, and having a plurality of leaves, comprising:

an index element adapted to extend from an edge location along said book in between two leaves of the book;

arm means for positioning said index element at said edge location whereby said index element is inserted between said leaves; and support means secureable to said book for supporting said arm means, said support means including a base member having a first leg portion adapted to extend alongside the spine of the book and a second leg portion adapted to extend over a joint portion of said leaves, and a rigid finger projecting from said second leg portion in fixed spaced relation to said first leg portion and positioned to extend into a gutter portion of the book spaced from the joint portion of said book.

2. An indexing device according to claim 1 wherein said index element is defined by an elongated flexible resilient prong.

3. An indexing device according to claim 1 wherein said arm means is pivotally mounted to said support means whereby said arm means may pivot in a plane generally perpendicular to the leaves and cover boards of the book.

4. An indexing device according to claim 3 including resistance means for resisting the pivotal movement of said arm means.

5. An indexing device according to claim 4 wherein said resistance means is effective to resist torque forces of less than 40,000 dyne cm.

6. An indexing device adapted as a bookmark for marking a reader's place in a book, having a spine, a pair of cover boards and a plurality of leaves, comprising:

mounting means for securing a base to said book, said mounting means including a base member having a first leg portion adapted to extend alongside the spine of the book and a second leg portion adapted to extend over a joint portion of said leaves, and a finger projecting from said second leg portion in spaced relation to said first leg portion and positioned to be inserted into the gutter portion of said book;

an arm member pivotally mounted to said base and extending alongside a gathering of said leaves;

a trunnion pin on one of said base and said arm member and a complementary hole on the other of said base and arm member sized to receive said trunnion pin, said trunnion pin terminating in an outward flange whereby said base and arm member may be snap-fitted together, said trunnion pin being split into segments sized to exert radially frictional force against said hole for resisting relative pivotal movement of said base and arm member; and a prong mounted adjacent a free end of said arm member whereby said prong may extend in between two consecutive leaves to indicate the reader's place in said book.

7. An indexing device according to claim 6 wherein said prong is resilient.

8. An indexing device according to claim 7 wherein the resiliency of said prong and the resistive ability of said trunnion pin are selected so that a single leaf of said book is deflected by said prong to pass thereby as the single leaf is turned by the reader, yet a force exerted by turning a group of at least four leaves acting on said prong will overcome the resistive ability of said trunnion pin whereby the arm member will be pivoted by said group of leaves so that the prong is maintained between said group and an adjacent one of said leaves.

* * * * *